US006805038B2

(12) United States Patent
Albright

(10) Patent No.: US 6,805,038 B2
(45) Date of Patent: Oct. 19, 2004

(54) HYDRAULIC CYLINDER PIVOT PIN

(75) Inventor: Larry E. Albright, Gwinner, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 70 days.

(21) Appl. No.: 10/271,928

(22) Filed: Oct. 16, 2002

(65) Prior Publication Data

US 2004/0074384 A1 Apr. 22, 2004

(51) Int. Cl.[7] ..... F01B 15/04
(52) U.S. Cl. ..... 92/118; 403/152
(58) Field of Search ..... 92/118, 117 R, 92/119, 76, 169.1; 403/373, 374.1, 374.2, 374.3, 150, 152, 163

(56) References Cited

U.S. PATENT DOCUMENTS

| | | | | | |
|---|---|---|---|---|---|
| RE6,490 | E | * | 6/1875 | Kline | 403/147 |
| 639,415 | A | * | 12/1899 | Lutz | 403/152 |
| 1,913,513 | A | * | 6/1933 | Rossman et al. | 403/152 |
| 2,293,167 | A | | 8/1942 | Overbeke | 121/38 |
| 2,406,940 | A | * | 9/1946 | Brill | 403/153 |
| 2,849,263 | A | | 8/1958 | Johnson | 309/2 |
| 2,979,369 | A | | 4/1961 | Flick et al. | 309/2 |
| 3,000,357 | A | | 9/1961 | Geyer | 121/38 |
| 3,202,062 | A | | 8/1965 | Burden | 92/85 |
| 3,600,015 | A | * | 8/1971 | McMullen | 403/156 |
| 3,715,039 | A | | 2/1973 | Kollmann et al. | 212/55 |
| 3,980,321 | A | * | 9/1976 | Hamilton | 403/156 |
| 4,096,957 | A | * | 6/1978 | Iverson et al. | 403/154 |
| 4,167,979 | A | | 9/1979 | Freese et al. | 172/801 |
| 4,192,622 | A | * | 3/1980 | Stecklein | 403/146 |
| 4,211,150 | A | * | 7/1980 | Framberg | 92/119 |
| 4,243,341 | A | * | 1/1981 | Kabay et al. | 403/158 |
| 4,326,749 | A | | 4/1982 | Bender | 298/22 |
| 4,398,862 | A | * | 8/1983 | Schroeder | 403/162 |
| 4,491,436 | A | * | 1/1985 | Easton | 403/146 |
| 4,700,616 | A | | 10/1987 | Stoll et al. | 92/118 |
| 4,726,282 | A | | 2/1988 | LaBair | 92/5 |
| 4,913,577 | A | * | 4/1990 | Forslund et al. | 403/158 |
| 4,951,350 | A | * | 8/1990 | Nunes | 403/156 |
| 5,088,881 | A | * | 2/1992 | Ball et al. | 403/162 |
| 5,117,741 | A | | 6/1992 | Richards | 92/119 |
| 5,507,218 | A | | 4/1996 | Lipinski | 92/88 |

FOREIGN PATENT DOCUMENTS

| | | |
|---|---|---|
| DE | 3500891 C1 | 6/1986 |
| DE | 9411004 | 8/1994 |
| EP | 1 172 324 A1 | 1/2002 |
| WO | WO 99/39127 | 8/1999 |
| WO | WO 03/066507 A1 | 8/2003 |

OTHER PUBLICATIONS

PCT International Search Report.

* cited by examiner

*Primary Examiner*—Thomas E. Lazo
(74) *Attorney, Agent, or Firm*—Westman, Champlin & Kelly, P.A.

(57) ABSTRACT

A pivot pin is provided for pivotally connecting a hydraulic actuator to a power machine. The pivot pin includes a first pin part having a first bolt-receiving passageway. The pivot pin also includes a second pin part having a second bolt-receiving passageway. In addition, the pivot pin includes a bolt that extends through and is engaged by the first and second bolt-receiving passageways.

16 Claims, 8 Drawing Sheets

HYDRAULIC CYLINDER PIVOT PIN

BACKGROUND OF THE INVENTION

The present application generally pertains to telescoping lift arms that may be utilized, either in pairs or as an individual arm, in the context of a loader, such as a skid steer loader. More specifically, the present application pertains to pivot pin configurations designed to accommodate hydraulic extension cylinders having a port opening that leads to an internal chamber.

Telescoping lift arms have been well known and used in various applications, including front-end loaders, skid steer loaders, crane booms, and the like. Certain known telescoping lift arms include a hydraulic extension cylinder that is configured to slide or telescope an inner lift arm section relative to an outer lift arm section in response to an instruction or signal. In this way, the overall length of the lift arm or boom can be desirably adjusted.

It is known for the base end and/or the rod end of a hydraulic extension cylinder to include a pivotal connection that enables the extension cylinder to be raised and lowered as its associated lift arm or boom is raised and lowered. With traditional hydraulic extension cylinders, the pivotal connection is known to be formed utilizing a pivot pin that that extends squarely through the base end and/or rod end of the extension cylinder. However, this type of pivotal connection does not accommodate hydraulic cylinder designs having a fluid line port or a linear position sensor port formed within the base end and/or rod end of the extension cylinder. Generally speaking, such ports lead to internal chambers formed within the hydraulic extension cylinder. It is generally desirable that no pivotal connection component substantially blocks or interrupts these internal chambers or their associated ports.

SUMMARY OF THE INVENTION

An embodiment of the present invention pertains to a pivot pin for pivotally connecting a hydraulic actuator to a power machine. The pivot pin includes a first pin part having a first bolt-receiving passageway. The pivot pin also includes a second pin part having a second bolt-receiving passageway. In addition, the pivot pin includes a bolt that extends through and is engaged by the first and second bolt-receiving passageways.

Another embodiment pertains to a hydraulic actuator for extending and retracting a telescoping lift arm associated with a power machine. The hydraulic actuator includes an end member. The end member includes an internal chamber and a first inset that includes a first bolt-receiving aperture. The end member also includes a second inset that includes a second bolt-receiving aperture. The first and second insets are positioned such that the first and second bolt-receiving apertures are aligned with one another. A bolt path is formed through the end member between the fist and second bolt-receiving apertures. The bolt path is displaced from the internal chamber.

Still another embodiment pertains to a power machine that includes a frame that supports a plurality of ground engaging wheels. The power machine also includes a cab that is operably coupled to the frame and defines an operator compartment. The power machine also includes an engine that is operably coupled to the wheels. The power machine also includes a telescoping lift arm that is operably coupled to the frame and includes first and second rotation apertures that are positioned opposite one another. Further, the power machine includes a hydraulic cylinder for extending and retracting the telescoping lift arm. The hydraulic cylinder includes an end member having an internal chamber formed therein. The end member also includes a first inset having a first bolt-receiving aperture, and a second inset that includes a second bolt-receiving aperture. A portion of the internal chamber is positioned between the first and second insets. The first and second insets are positioned such that the first and second bolt-receiving apertures are aligned with one another. A bolt path is formed through the end member between the fist and second bolt-receiving apertures. The bolt path is displaced from the internal chamber. The end member also includes a first pin part having a first bolt-receiving passageway. The first pin part is engaged within the first inset and is pivotally received within the first rotation aperture. The end member also includes a second pin part having a second bolt-receiving passageway. The second part is engaged within the second inset and is pivotally received within the second rotation aperture. The end member also includes a bolt that extends through the first bolt-receiving passageway, through the first bolt-receiving aperture, through the bolt path, through the second bolt-receiving aperture, and through the second bolt-receiving passageway.

DETAILED DESCRIPTION OF THE PREFERRED EMBODIMENTS

Figure 1:
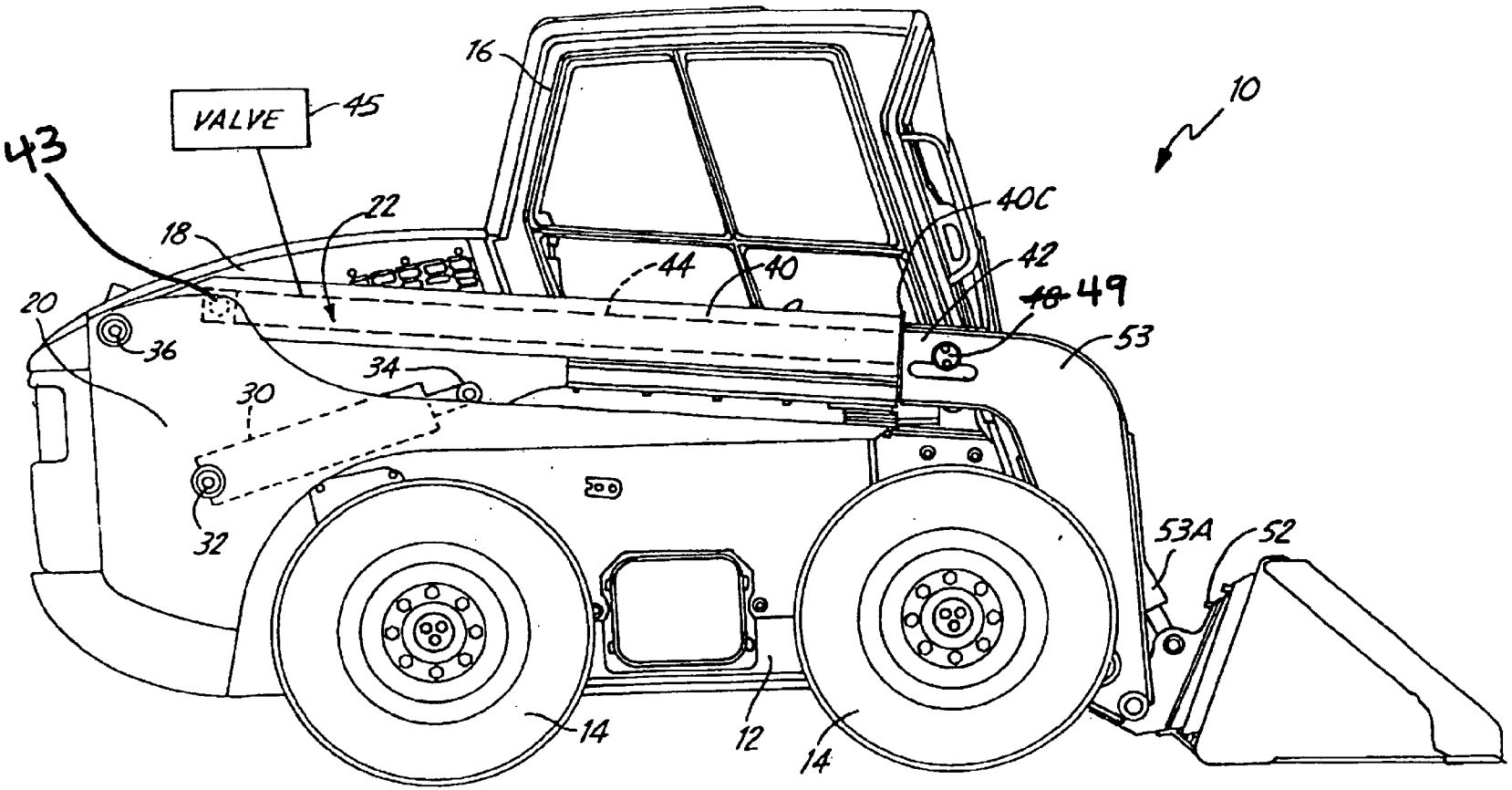
FIG. 1 is a schematic side elevational view of a skid steer loader having a lift arm assembly that enables a pair of telescoping loader arms to be extended and retracted.
Figure 2:
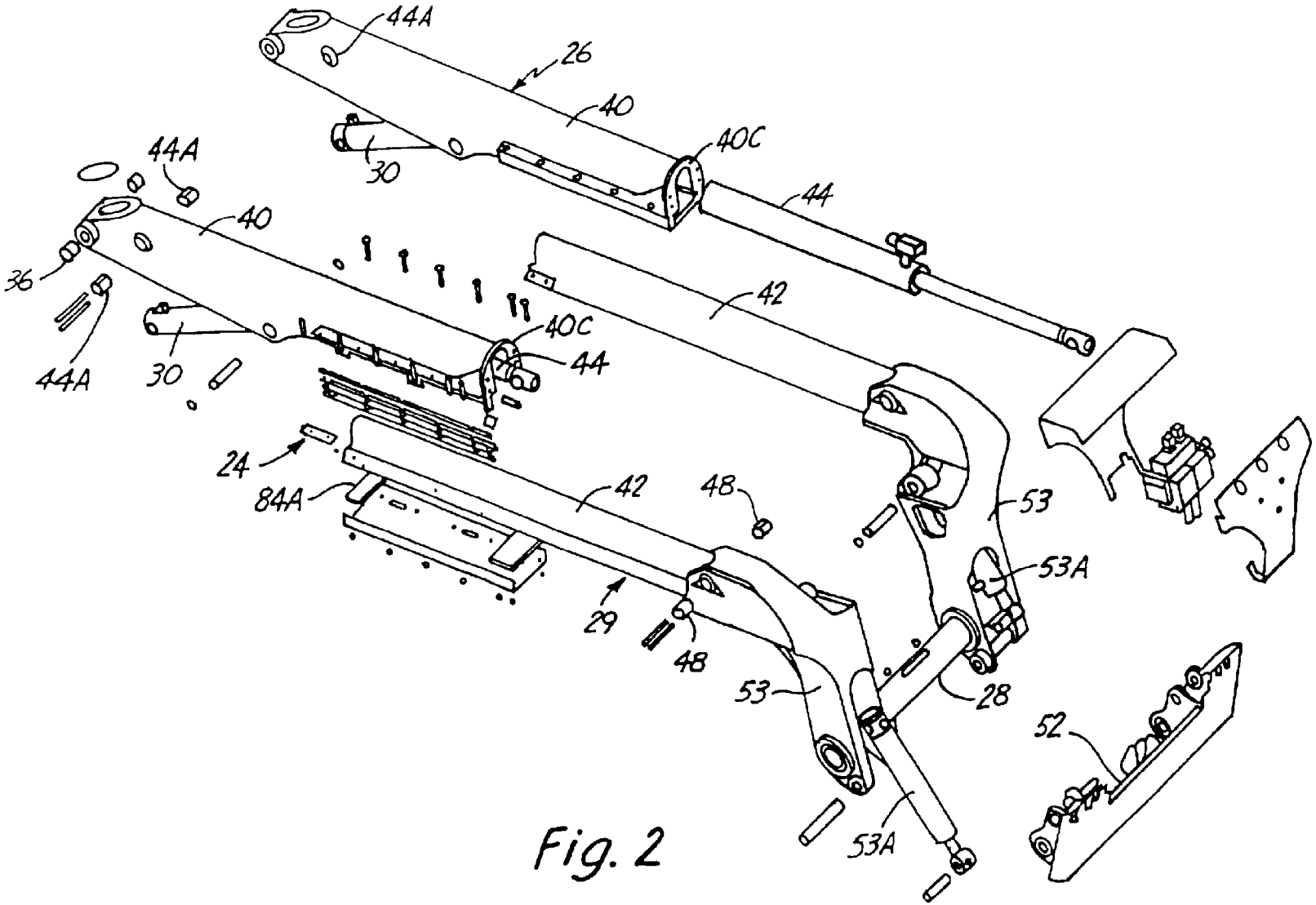
FIG. 2 is an exploded perspective view of the lift arm assembly.

FIG. 1 is a schematic representation of a skid steer loader 10 having a pair of telescoping loader arms (also known as loader booms). Skid steer loader 10 includes a lift arm assembly 22 for extending and retracting the telescoping loader arms. FIG. 2 is an exploded view of lift arm assembly 22.

It should be noted that skid steer loader 10 includes telescoping lift arms having a bell-shaped cross section that permits an inner lift arm to slide or telescope relative to an outer lift arm while being guided along linear bearings. This specific telescoping lift arm arrangement, which should be considered only one illustrative arrangement of many that are suitable to accommodate embodiments of the present invention, is described specifically in co-pending U.S. application Ser. No. 10/123,469 filed on Apr. 15, 2002, and entitled "TELESCOPING LOADER LIFT.ARM".

Skid steer loader 10 has a frame 12, and drive wheels 14 for propelling the loader across the ground. Frame 12 supports an operator's cab 16, and an engine compartment 18 for housing the engine (not shown). The frame 12 also includes boom support plates or frame members 20 on which the lift arm assembly 22 is pivotally mounted on pivots 36. The lift arm assembly 22 comprises individual lift arms 24 and 26, one pivoted on each of the opposite sides of the skid steer loader. The two lift arms are identical except that one is on the right-hand side and the other is on the left-hand side.

The lift arm assembly 22 is made up of an individual inner lift arm tube 42 that is held in a complimentary-shaped outer arm tube 40. The inner tubes 42 are held together with a suitable cross member 28 proximate their forward ends. The outer end of lift arm assembly 22 is raised and lowered by pivoting the lift arm assembly about the pivots 36 with hydraulic cylinders 30 that have base end pivots 32 connected to the vehicle frame, and rod ends connected at pivots 34 to the lift arms 24 and 26. The actuators 30 are controlled in a conventional manner using suitable valves in the hydraulic system of the skid steer loader.

Each of the telescoping tubular lift arms 24 and 26 includes the main outer lift arm tube or housing 40 and the telescoping inner lift arm tubes 42. The inner lift arm tubes 42 telescope relative to the outer lift arm tubes 40 as an inner assembly 29. The lift arm tube 42's fit inside the outer lift arm tubes 40 and slide longitudinally relative thereto. The inner assembly 29 of the inner lift arm tubes is moved as a unit through the use of hydraulic actuators 44. A collar 40C is provided proximate the end of outer lift arm tubes for reinforcing and adding rigidity to the side walls of the outer tube.

As shown, the base ends of actuators 44 are pivotally mounted to the outer lift arm housings or tubes on a pivotal connection 43, so that the actuators 44 pivot up and down therewith. Each actuator 44 also has a rod end pivotally connected to the inner lift arm tubes 42 on a pivotal connection 49.

Upon extending and retracting the actuator cylinders 44 with a suitable valve 45, the inner lift arm tubes 42 are extended and retracted. The inner lift arm tube assembly 29, as shown, has a tool or accessory attachment connection plate 52 proximate its outer or forward ends. Depending side frames 53, which are fixed to the inner lift arm tubes 42, are connected with a cross member 28. The attachment plate is pivotally mounted to the lower ends of the side frame 53 and optionally controlled with control cylinders 53A. Cross member 28 can be used for mounting a hydraulic valve. In accordance with one embodiment, a hydraulically actuated device is illustratively mounted on the distal end of the loader arms (e.g., mounted to the attachment plate) and operably connected to a hydraulic valve mounted on cross member 28.

Figure 3A:
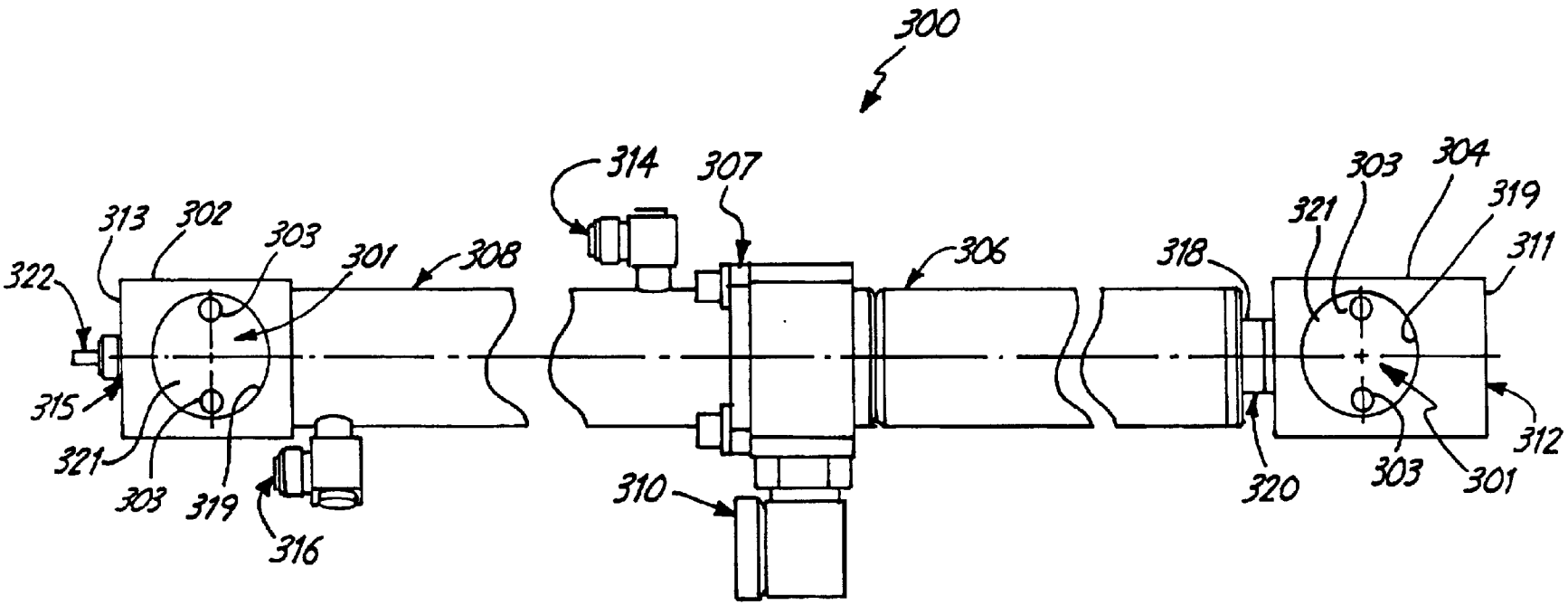
FIG. 3A is a side view of a hydraulic actuator.
Figure 3B:
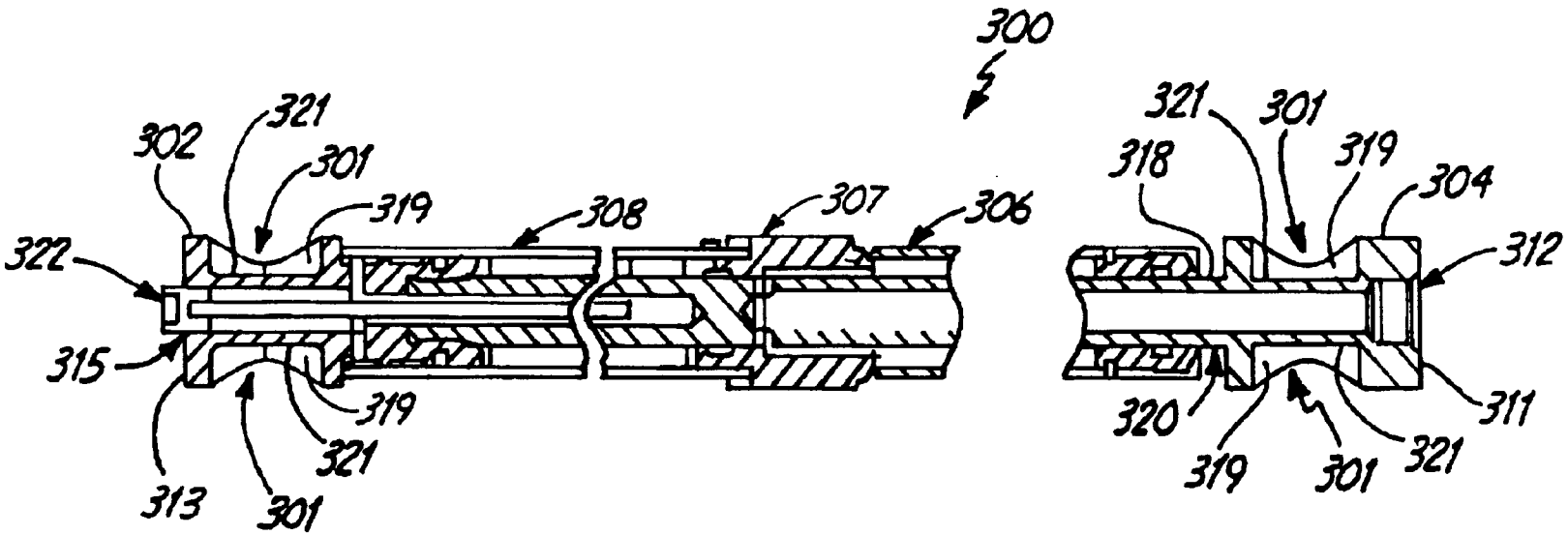
FIG. 3B is a cross-sectional view of the hydraulic actuator depicted in FIG. 3A.

FIG. 3A is a side view of hydraulic actuator 300. FIG. 3B is a cross-sectional view of hydraulic actuator 44. Hydraulic actuator 300 is of an overall size and configuration making it generally appropriate for use as hydraulic actuator 44 in skid steer loader 10 (FIGS. 1 and 2). Actuator 300 includes a front tube portion 306 that is connected to a rear tube portion 308 at a connection point 307. A base end 302 is connected to rear tube portion 308. A rod end 304 is connected to a distal end 318 of a rod 320. Base end 302 and rod end 304 each include connection insets 301 and bolt-receiving apertures 303. In accordance with one aspect of the present invention, insets 301 and their corresponding apertures 303 are designed to facilitate a particular pivotal connection configuration for pivotal connections 43 and 49, the details of which will be described below in relation to other Figures. Rod 320 extends through and is slidably and engaged within front tube portion 306, connection point 307 and rear tube portion 308.

In accordance with one aspect of the present invention, each inset 301 is a counter-bored indention formed by a generally circular wall 319 that engages an inset floor 321. In association with each of base end 302 and rod end 304, two insets 301 are positioned such that one inset 301 is positioned on a first side of an internal chamber formed within end 302 and 304, and the other inset 301 is positioned on an opposite side of the internal chamber. Accordingly, two inset floors 321 are positioned opposite one another, with one on either side of the internal chamber. Apertures 303 extend through the inset floors 321 and contribute to two bolt paths that are positioned on either side of the internal chamber. Accordingly, within each of ends 302 and 304, an internal chamber is disposed between two bolt paths, and between two inset floors 321.

A proximal end of rod 320 is connected to a piston (not shown in FIG. 3A) that is controlled in a conventional manner. The piston is illustratively driven by a suitable valve or valves within the hydraulic system of skid steer loader 10 (e.g., valve 45 in FIG. 1) so as to enable rod 320 to be desirably extended and retracted. Rear tube portion 308 includes fluid conduit openings 314 and 316 through which fluid is transferred to desirably drive the piston in one direction or the other, thereby causing rod 320 to extend and retract as described. In this way, in the context of skid steer loader 10, the inner lift arm tube 42, which is connected to rod end 304, can be telescopically extended or retracted, thereby causing a corresponding extension or retraction of the associated lift arm.

Hydraulic actuator 300 further includes a fluid conduit opening or port 312 that is situated within a distal end 311 of the actuator. Fluid conduit opening 312 is illustratively configured for connection to a hydraulically actuated tool. Fluid conduit or port 312 illustratively leads to and is in communication with an internal hollow chamber, a portion of which is formed within rod end 304, and a portion of which is formed within rod 320. A portion of the internal hollow chamber is positioned between the two bolt paths that correspond to apertures 303 in inlets 301. A portion of the internal hollow chamber is also positioned between the two inset floors 321.

Hydraulic actuator 300 also includes a sensor opening or port 315 that is situated within a proximal end 313 of the actuator. Sensor opening or port 315 illustratively leads to and is in communication with an internal hollow chamber, a portion of which is formed within base end 302, and a portion of which is formed within rear tube portion 308. A portion of the internal hollow chamber is positioned between the two bolt paths that correspond to apertures 303 in inlets 301. A portion of the internal hollow chamber is also positioned between the two inset floors 321.

A portion of a sensor 322 extends through port 315 and into the above-described hollow chamber. Sensor 322 is utilized to monitor the extension status of rod 320 and/or its associated piston, and therefore of an extendable lift arm associated with skid steer loader 10. In accordance with the specifically illustrated embodiment, sensor 322 is a linear displacement potentiometer configured to monitor how far rod 320 (and/or its associated piston) is extended or retracted relative to a sensor pin that co-axially extends at least part of the way through rear tube portion 308. Sensors other than a linear displacement potentiometer could alternatively be utilized to monitor the extension status of rod 420 (and/or its associated piston) without departing from the scope of the present invention.

Hydraulic actuator 300 in FIGS. 3A and 3B is merely representative of a type of actuator that can be used to enable telescoping movement of the inner lift arm tubes. Without departing from the scope of the present invention, the pivot pin configurations disclosed herein can be utilized in the context of other hydraulic actuators. Certain hydraulic actuators, including actuator 300, have a fluid line port and/or a linear position sensor port formed within a base end and/or rod end. Such ports typically lead to internal chambers formed within the actuator. It is generally desirable that these internal chambers, as well as the port openings themselves, not be substantially blocked or interrupted by structures associated with attachment of the actuator to another portion of a skid steer loader 10 (e.g., attachment at pivotal connections 43 and 49).

Figure 4A:
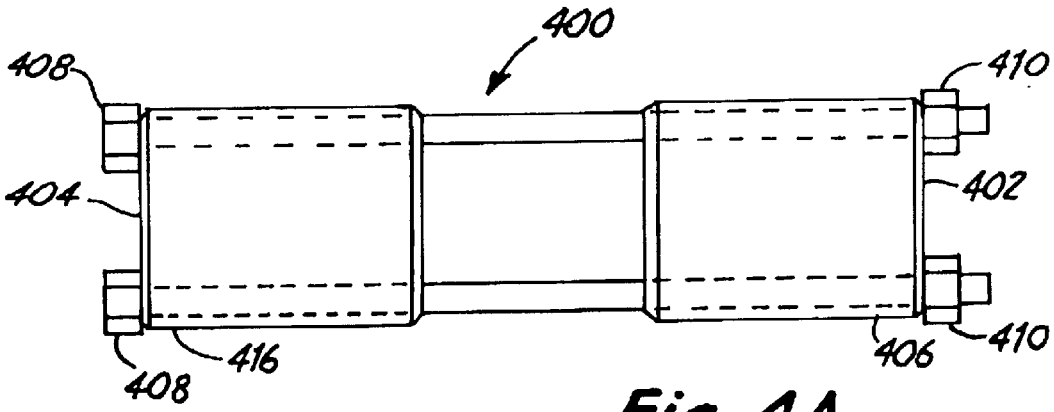
FIG. 4A is a side view of a pivot pin assembly.
Figure 4B:
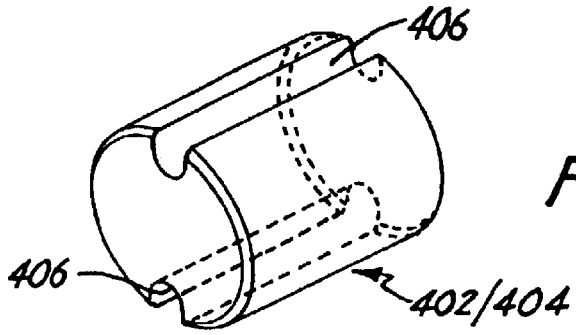
FIG. 4B is a perspective view of a pivot pin part.

FIG. 4A is a side view of a pivot pin assembly 400 in accordance with one aspect of the present invention. Pivot pin assembly 400 includes a first pin part 402 and a second pin part 404. FIG. 4B is a perspective view of a pin part that is representative of first pin part 402 and second pin part 404.

Figure 4C:
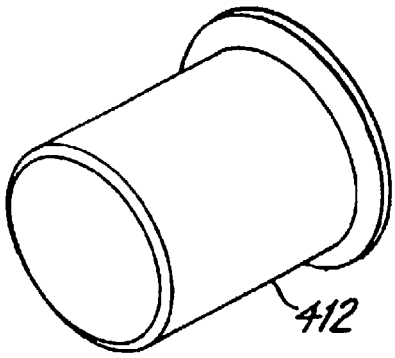
FIG. 4C is a perspective view of an optional busing.

As is illustrated in FIG. 4B, pin parts 402 and 404 each include two bolt-receiving grooves 406. As is indicated in FIG. 4A, bolts 408 are configured to rest in bolt-receiving grooves 406 such that the grooves 406 in first pin part 402 are in alignment with the grooves 406 formed in second pin part 404. FIG. 4C is a perspective view of an optional bushing 412. In accordance with one embodiment, a bushing 412 is optionally slid over each of pin parts 402 and 404 to hold bolts 408 within grooves 406, and to provide a smooth and continuous surface for rotation within a rotation aperture. In accordance with another embodiment, however, item 412 is a collar welded to the lift arm tube to provide a rotation aperture.

It should be pointed out that bolt-receiving grooves 406 could alternatively be through-holes. A bushing or welded collar 412 could be utilized regardless of whether pin parts 402 and 404 include grooves 406 or through-holes. Grooves are illustratively utilized in association with application wherein minimal rotation is expected. In such instances, the pin diameter could be minimized. For applications that involve more significant rotation, through-holes could be utilized. In such instances, bushings 412, rather than welded collars 412, could be utilized as greaseless wear bushing/bearing to accommodate the rotation. Nuts 410 are threaded onto the ends of bolts 408 in order to secure pin parts 402/404, as well as optional bushings 412 if necessary, in place. In should be pointed out that incorporation of either bushings 412 or welded-in collars 412 is an optional element.

Pivot pin assembly 400 is illustratively configured to pivotally connect hydraulic actuator 300 (FIGS. 3A and 3B) to skid steer loader 10 (FIGS. 1 and 2). For example, pivot pin assembly 400 is configured to pivotally connect base end 302 of hydraulic actuator 300 to outer lift arm tubes 40 at pivotal connection 43. Similarly, pivot pin assembly 400 is configured to pivotally connect rod end 304 of hydraulic actuator 300 to inner lift arm tubes 42 at pivotal connection 49. Pivot pin assembly 400 enables pivotal connections 43 and 49 that do not substantially block or interrupt the ports or internal chambers associated with the ends of hydraulic actuator 300.

In order accommodate the pivotal connection of hydraulic actuator 300 to skid steer loader 10, pivot pin parts 402 and 404 are configured to be mounted in inlets 301, and are configured to be rigidly secured therein by bolts 408. Bolts 408 extend through bolt-receiving apertures 303 and grooves 406, and then are secured with nuts 410. In other words, in association with base end 302 and/or rod end 304 of hydraulic actuator 300, pin piece 402 is inserted into an inset 301 on one side of the end piece, and pin piece 404 is inserted into the inlet 301 on the opposite side of the end member. In embodiments that incorporate wear bushings 412, they are then placed over pin pieces 402 and 404. As described above, other embodiments incorporate fixed welded-in collars. Next, bolts 408 are inserted through the bolt paths formed in association with grooves 406 and apertures 303. Nuts 410 are then threaded onto the end of bolts 408 in order to secure together the various pieces of pin assembly 400. In accordance with one embodiment, a fully assembled pin assembly 400 is configured to pivotally rotate in rotation apertures formed in outer lift arm housings 40 so as to form pivotal connection 43 for the hydraulic actuator 44. Alternatively or in addition, pivot pin assembly 400 is configured to pivotally rotate in rotation apertures formed in inner lift arm tubes 42 so as to form pivotal connection 49.

Figure 5:
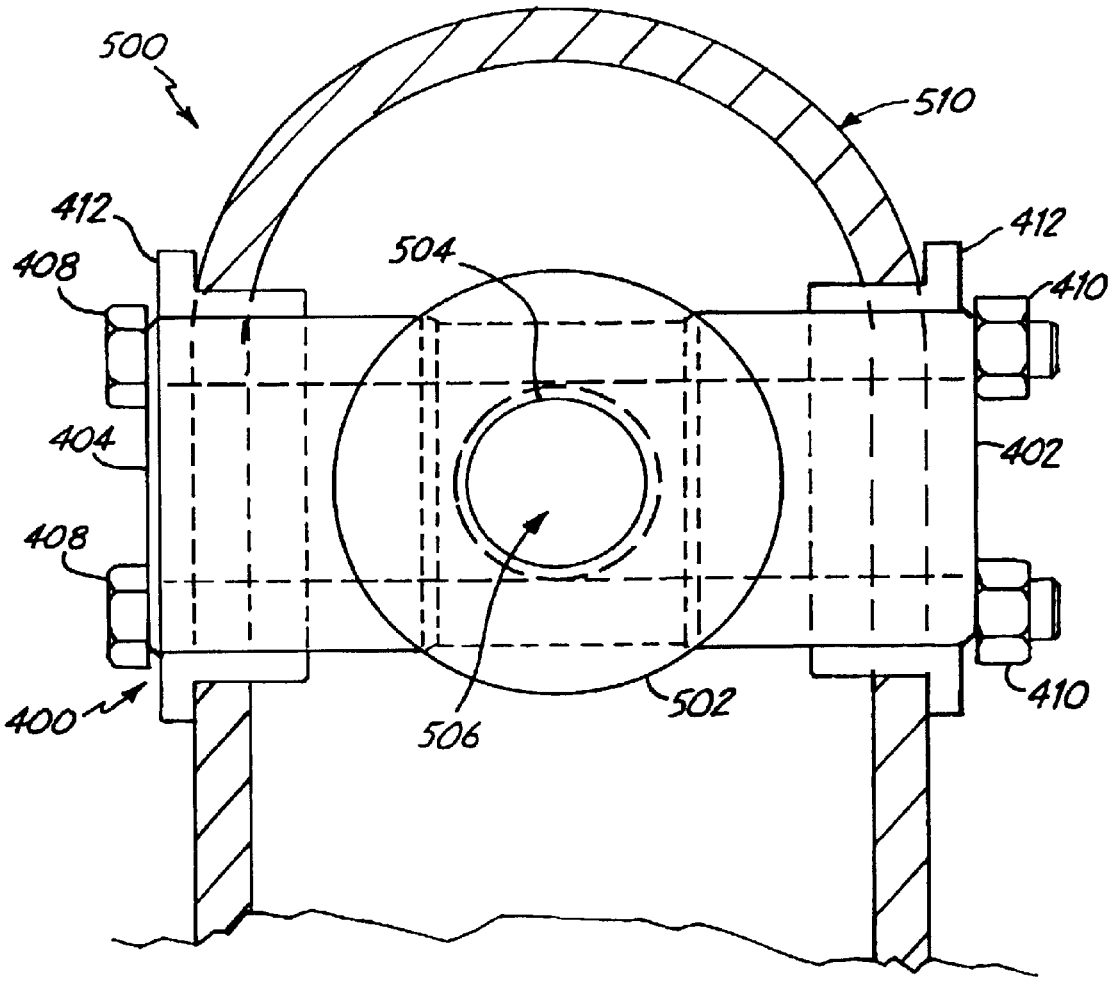
FIG. 5 is a partially broken away diagramatic view of a pivot pin system.

FIG. 5 is a partially broken away diagramatic view of a pivot pin system 500. Pivot pin system 500 includes a pivot pin assembly 400, as described in relation to FIGS. 4A–4C. As illustrated in FIG. 5, pivot pin assembly 400 includes an optional busing or optional welded-in collar 412 engaged over each of pin parts 402 and 404. Pin parts 402 and 404 are connected to a hydraulic cylinder end 502. Hydraulic cylinder end 502 is illustratively either base end 302 or rod end 304 of hydraulic actuator 300. It should be pointed out that rod ends, base ends, and other components illustrated herein as having a round or cylinder configuration could just as easily have a rectangular shape or configuration without departing from the scope of the present invention. Hydraulic cylinder end 502 includes inlets 301 as described in relation to ends 302 and 304, and also includes a port opening 504 that leads to an internal chamber 506. The connection between hydraulic cylinder end 502 and pin parts 402/404 is illustratively similar to the connection scheme described above in relation to FIGS. 4A–4C. In general, pivot pin assembly 400 enables the hydraulic cylinder associated with end 502 to be pivotally connected without interfering with or blocking port opening 504 or internal chamber 506.

Pivot pin assembly 400 is pivotally engaged by rotation apertures formed in housing 510. In FIG. 5, for illustrative purposes, housing 510 has been broken away to reveal the components of pivot pin assembly 400. Optional bushings 412 are illustratively pivotally engaged by the rotation apertures formed in housing 510. In this manner, as the hydraulic actuator associated with actuator end 502 is raised and lowered, pivot pin assembly 400 is able to rotate within the housing 510 rotation apertures as necessary.

In the context of previously described Figures, if pivot pin assembly 400 is utilized in association with pivotal connection 43 at based end 302 of hydraulic cylinder 300, then pivot pin assembly 400 will illustratively pivotally engage rotation apertures formed in the outer lift arm tubes 40. Housing 510 illustrated in FIG. 5 is illustratively configured similar to the outer lift arm tube 40 illustrated in FIGS. 1 and 2. If pivot pin assembly 400 is utilized in association with pivotal connection 49 at rod end 304 of hydraulic cylinder 300, then pivot pin assembly 400 will illustratively pivotally engage rotation apertures formed in the inner lift arm tubes 42 of skid steer loader 10.

Figure 6:
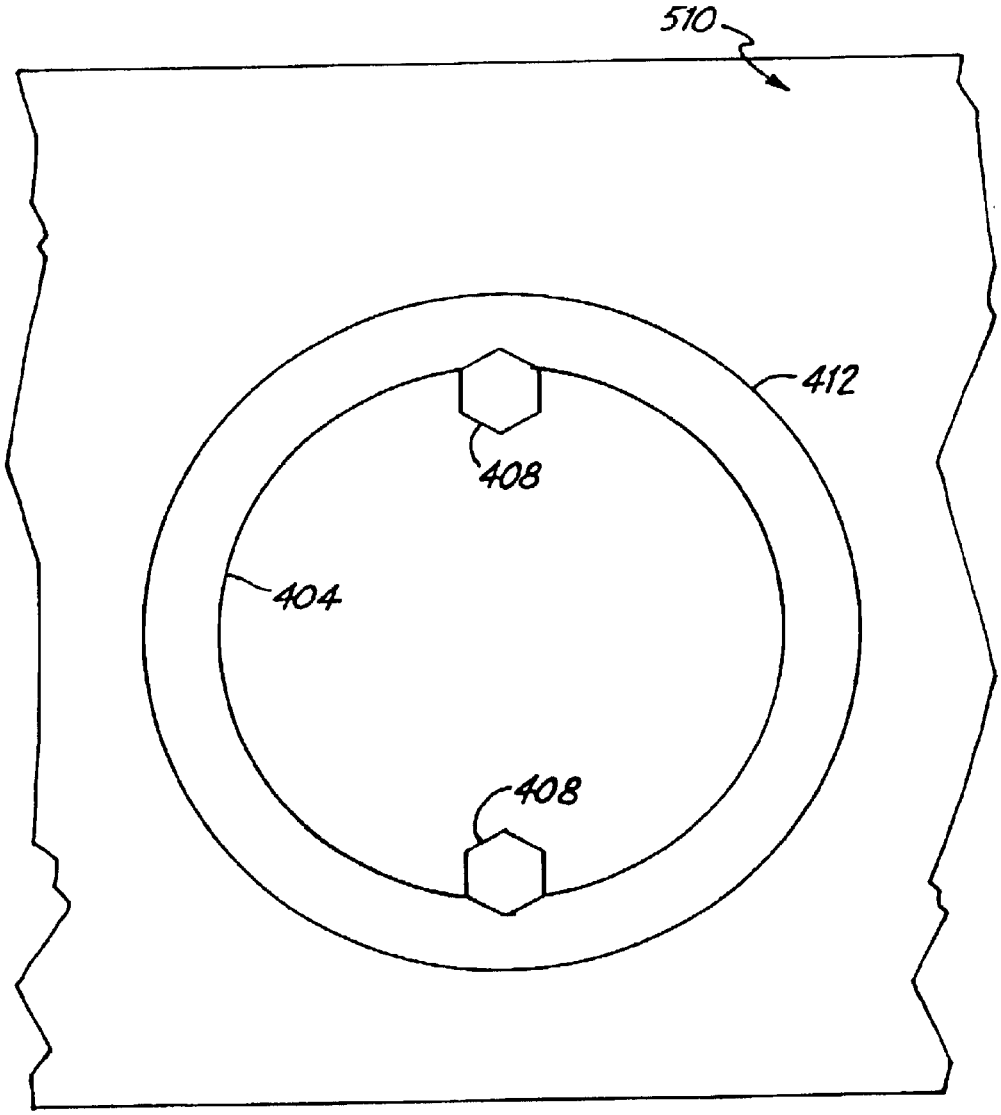
FIG. 6 is a partial side view of the pivot pin system.

FIG. 6 is a partial side view of pivot pin system 500. In FIG. 6, housing 510 has not been broken away. FIG. 6 illustrates how busing 412 is pivotally engaged by a rotation aperture formed in housing 510. In the context of embodiments that do not include an optional busing 412, pin piece 404 (and/or pin piece 402) is directly pivotally engaged by the rotation aperture formed in housing 510.

Figure 7:
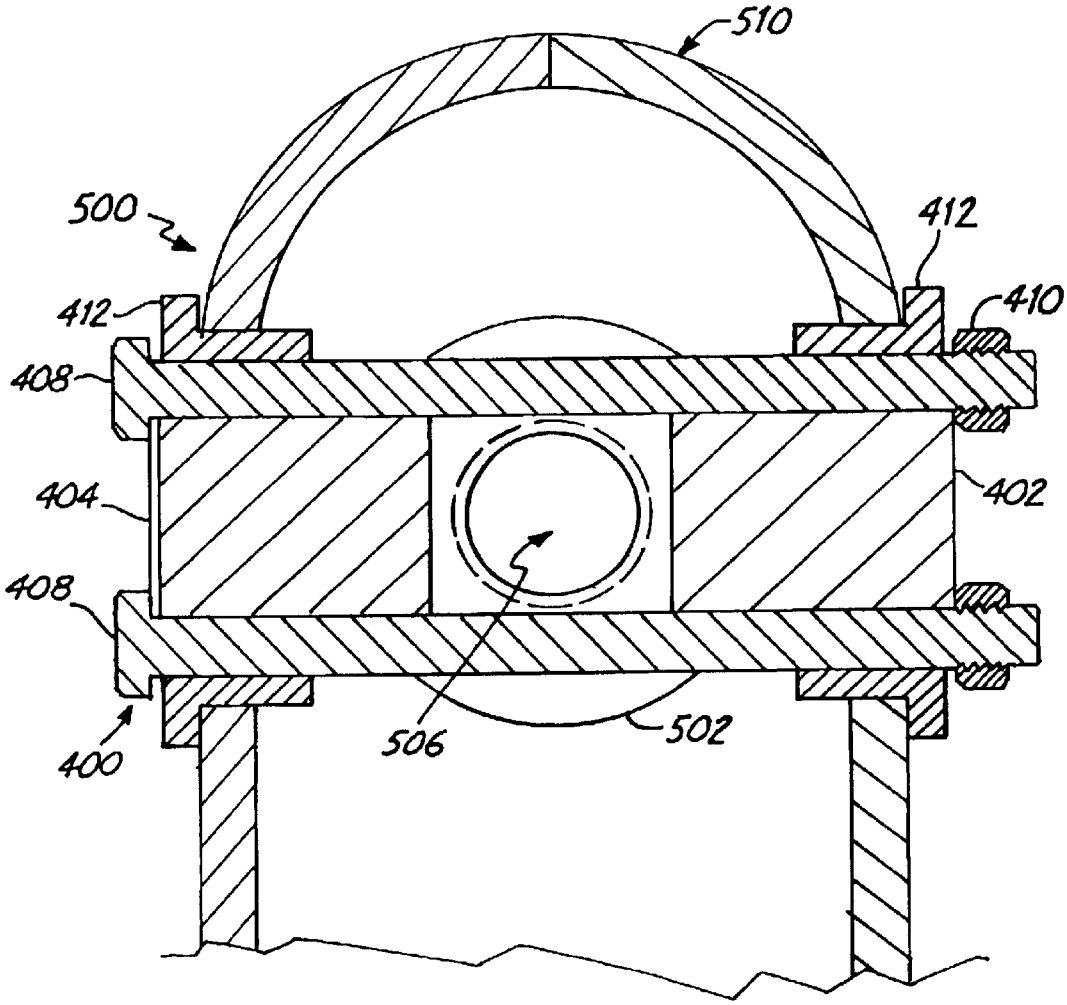
FIG. 7 is a cross-sectional view of the pivot pin system.

FIG. 7 is a cross-sectional view of pivot pin system 500. The cross-section is illustratively taken through the centerline of bolts 408. FIG. 7 illustrates how pin parts 402 and 404 extend into insets formed in actuator end 502.

Although the present invention has been described with reference to preferred embodiments, workers skilled in the art will recognize that changes may be made in form and detail without departing from the spirit and scope of the invention.

What is claimed is:

1. A pivot pin for pivotally connecting a hydraulic actuator to a power machine, comprising:

a first pin part having a first bolt-receiving passageway;

a second pin part having a second bolt-receiving passageway;

a bolt that extends through and is engaged by the first and second bolt-receiving passageways; and wherein the first pin part further comprises a third bolt-receiving passageway, the second pin part further comprises a fourth bolt-receiving passageway, and the pivot pin further comprises a second bolt that extends through and is engaged by the third and fourth bolt-receiving passageways.

2. The pivot pin of claim 1, wherein the first and second pin parts are displaced from one another and are concentrically positioned relative to one another.

3. A pivot pin for pivotally connecting a hydraulic actuator to a power machine, comprising:

a first pin part having a first bolt-receiving passageway;

a second pin part having a second bolt-receiving passageway;

a bolt that extends through and is engaged by the first and second bolt-receiving passageways; and wherein at least one of the first and second bolt-receiving passageways is a bolt-receiving groove.

4. A hydraulic actuator for extending and retracting a telescoping lift arm associated with a power machine, the hydraulic actuator comprising:

an end member that includes:

an internal chamber;

a first inset that includes a first bolt-receiving aperture;

a second inset that includes a second bolt-receiving aperture, the first and second insets being positioned such that the first and second bolt-receiving apertures are aligned with one another; and a bolt path formed through the end member between the fist and second bolt-receiving apertures, the bolt path being displaced from the internal chamber.

5. The hydraulic actuator of claim 4, further comprising:

a first pin part having a first bolt-receiving passageway, the first pin part being engaged within the first inset;

a second pin part having a second bolt-receiving passageway, the second part being engaged within the second inset; and a bolt that extends through the first bolt-receiving passageway, through the first bolt-receiving aperture, through the bolt path, through the second bolt-receiving aperture, and through the second bolt-receiving passageway.

6. The hydraulic actuator of claim 5, further comprising a nut that is engaged to an end of the bolt so as to secure the first and second pin parts within the first and second insets.

7. The hydraulic actuator of claim 5, further comprising a bushing that is engaged over at least one of the first and second pin parts.

8. The hydraulic actuator of claim 5, wherein the first and second pin parts are displaced from one another and are concentrically positioned relative to one another, and wherein a portion of the internal chamber is positioned between the first and second insets.

9. The hydraulic actuator of claim 5, wherein at least one of the first and second bolt-receiving passageways is a bolt-receiving groove.

10. The hydraulic actuator of claim 5, wherein at least one of the first and second bolt-receiving passageways is a bolt-receiving through-hole.

11. The hydraulic actuator of claim 4, wherein a portion of the internal chamber is positioned between the first and second insets.

12. A power machine, comprising:

a frame;

a plurality of ground engaging wheels supporting the frame;

a cab operably coupled to the frame and defining an operator compartment;

an engine operably coupled to the wheels;

a telescoping lift arm operably coupled to the frame and including first and second rotation apertures that are positioned opposite one another; and a hydraulic cylinder for extending and retracting the telescoping lift arm, wherein the hydraulic cylinder includes an end member having an internal chamber formed therein, wherein the end member also includes:

a first inset that includes a first bolt-receiving aperture;

a second inset that includes a second bolt-receiving aperture, wherein a portion of the internal chamber is positioned between the first and second insets, and wherein the first and second insets are positioned such that the first and second bolt-receiving apertures are aligned with one another;

a bolt path formed through the end member between the fist and second bolt-receiving apertures, the bolt path being displaced from the internal chamber;

a first pin part having a first bolt-receiving passageway, the first pin part being engaged within the first inset and pivotally received within the first rotation aperture;

a second pin part having a second bolt-receiving passageway, the second part being engaged within the second inset and pivotally received within the second rotation aperture; and a bolt that extends through the first bolt-receiving passageway, through the first bolt-receiving aperture, through the bolt path, through the second bolt-receiving aperture, and through the second bolt-receiving passageway.

13. The power machine of claim 12, further comprising a nut secured to an end of the bolt to secure the first and second pin parts within the first and second insets.

14. The power machine of claim 12, further comprising a bushing engaged over at least one of the first and second pin parts.

15. The power machine of claim 12, wherein at least one of the first and second bolt-receiving passageways is a bolt-receiving groove.

16. The power machine of claim 12, wherein at least one of the first and second bolt-receiving passageways is a bolt-receiving through-hole.

* * * * *